United States Patent [19]

Hill

[11] 4,381,752

[45] May 3, 1983

[54] COMBINED IGNITION CONTROL AND FUEL INJECTION VALVE OPERATING CIRCUIT FOR AN INTERNAL COMBUSTION ENGINE

[75] Inventor: William F. Hill, Stafford, England

[73] Assignee: Lucas Industries, Ltd., Birmingham, England

[21] Appl. No.: 256,537

[22] Filed: Apr. 22, 1981

[30] Foreign Application Priority Data

May 1, 1980 [GB] United Kingdom ..... 8014494

[51] Int. Cl.[3] ..... F02B 3/00; F02M 51/00; F02B 3/10

[52] U.S. Cl. ..... 123/475; 123/478; 123/490; 123/599

[58] Field of Search ..... 123/475, 478, 490, 599

[56] References Cited

U.S. PATENT DOCUMENTS 3,465,731 9/1969 Bassot et al. ..... 123/490

3,754,537 8/1973 Wessel et al. ..... 123/475

4,058,709 11/1977 Long ..... 123/475

4,073,270 2/1978 Endo ..... 123/490

4,082,066 4/1978 Long ..... 123/490

*Primary Examiner*—Raymond A. Nelli

*Attorney, Agent, or Firm*—Ferguson, Baker, Whitham, Spooner & Kroboth

[57] ABSTRACT

A combined ignition control and injection valve operating circuit has an inductor connected in (series or) parallel with the ignition coil so that it carries current whenever an output transistor of an ignition control circuit is on.

A thyristor connects the inductor to an energy storage capacitor and turns on each time the transistor turns off to create an ignition spark. The capacitor is thus charged up and the stored energy is discharged through a triac into an injection valve solenoid to speed up current growth in the latter on each energization thereof.

9 Claims, 3 Drawing Figures

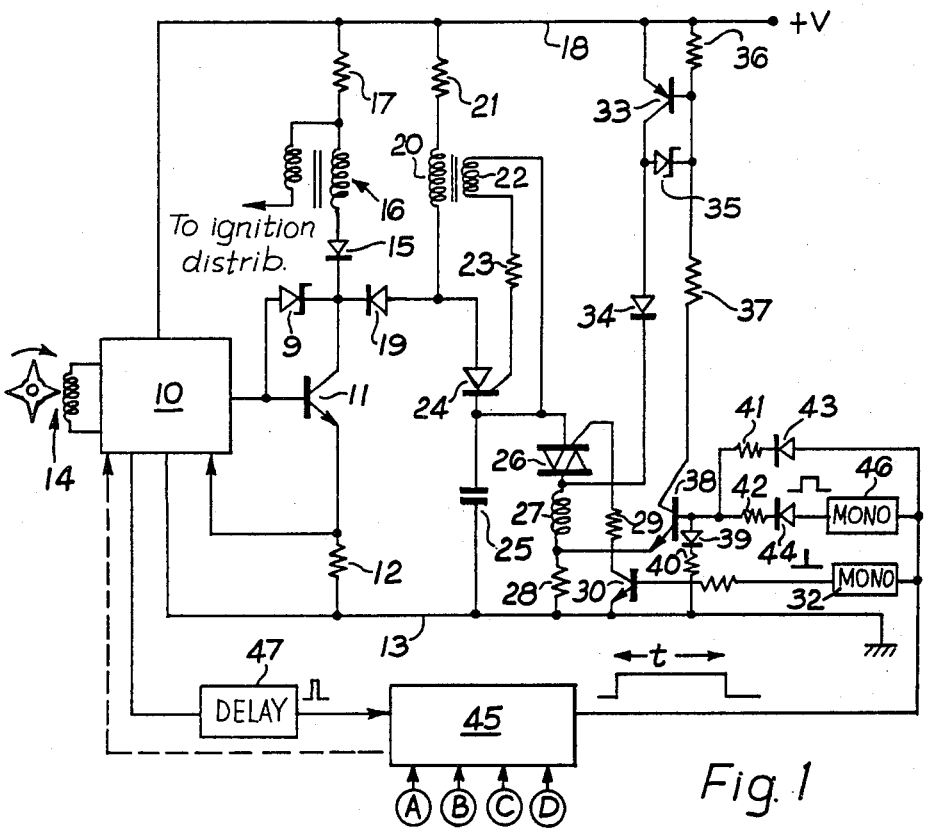
Fig. 1
Fig. 2
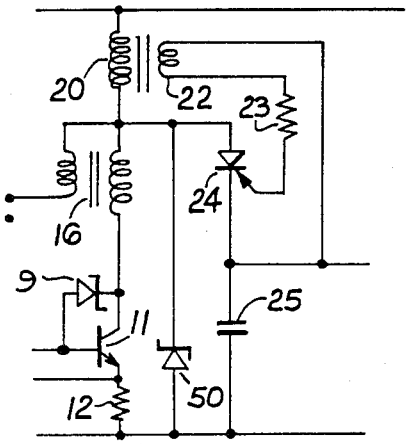
Fig. 3
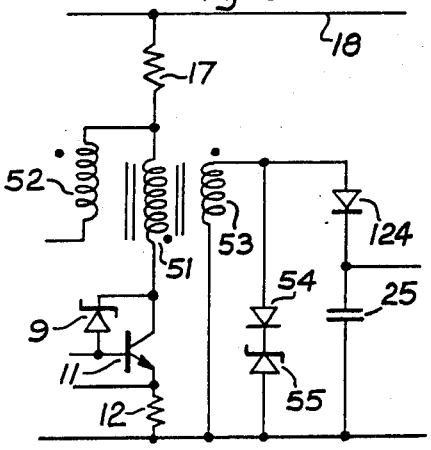

COMBINED IGNITION CONTROL AND FUEL INJECTION VALVE OPERATING CIRCUIT FOR AN INTERNAL COMBUSTION ENGINE

BACKGROUND OF THE INVENTION

This invention relates to a combined ignition control and fuel injection valve operating circuit for an internal combustion engine.

SUMMARY OF THE INVENTION

It is an object of the invention to provide a circuit in which rapid operation of the fuel injection valve can be obtained.

A circuit in accordance with the invention comprises an ignition control circuit including a semiconductor switch element controlling current flow in an ignition coil, an energy storage element, inductive means controlled by said switch element and coupled to said energy storage device, whereby each time current flow in said switch element is interrupted to create an ignition spark, electrical energy is stored in the energy storage element, and injection valve solenoid control means including switch means for connecting said energy storage device to the injection valve solenoid when energisation of said solenoid is commenced.

BRIEF DESCRIPTION OF THE DRAWINGS

In the accompanying drawings,

FIG. 1 is a circuit diagram of one example of a circuit in accordance with the invention and FIGS. 2 and 3 are diagrams showing two different modifications to the circuit of FIG. 1.

DETAILED DESCRIPTION OF PREFERRED EMBODIMENTS

Referring firstly to FIG. 1 the circuit shown includes a ignition control circuit 10 of which an output transistor 11 forms a part. The transistor 11 which is of npn type has its emitter connected via a current sensing resistor 12 to an earth rail 13. The circuit 10 is of known form triggered by a transducer 14 driven by the engine and having a feedback connection from the resistor 12 to provide constant current control. The collector of the transistor 11 is connected to the cathode of a diode 15 the anode of which is connected via the primary winding of an ignition coil 16 and a ballast resistor 17 in series to a positive voltage supply rail 18. The secondary winding of the ignition coil 16 is connected, as usual, via a distributor to the spark plugs (not shown). A zener diode 9 is connected across the base-collector of transistor 11.

The collector of transistor 11 is also connected to the cathode of another diode 19, the anode of which is connected via an inductor 20 and a further ballast resistor 21 in series to the rail 18. In fact, the inductor 20 has a secondary winding 22 associated with it and this secondary winding 22 is connected in series with a resistor 23 across the gate-cathode of a thyristor 24. The thyristor 24 has its anode connected to the anode of diode 19 and its cathode connected to one terminal of a capacitor 25 the other terminal of which is connected to the earth rail 13. The capacitor 25 is an energy storage element which receives electrical energy from the inductor 20 when the transistor 11 switches off as will be further explained hereinafter.

A triac 26 is connected in series with a fuel injection valve solenoid 27 and a current sensing resistor 28 across the capacitor 25 and has its gate terminal connected by a resistor 29 to the collector of an npn transistor 30 which has its emitter connected to rail 13 and its base connected by a resistor 31 to the output of a monostable circuit 32. A pnp transistor 33 has its emitter connected to the rail 18 and its collector connected by a diode 34 to the solenoid 27. A zener diode 35 is connected across the base-collector of the transistor 33. The base of transistor 33 is connected to the junction of two resistors 36, 37 connected in series between rail 18 and the collector of an npn transistor 38, the emitter of which is connected to the junction between the solenoid 27 and the resistor 28. The base of transistor 38 is connected by a diode 39 and a resistor 40 in series to the rail 13 and also by two resistors 41, 42 to the cathodes of two diodes 43, 44. The anode of the diode 43 is connected to the output of a pulse duration control circuit 45 and the anode of diode 44 is connected to the output of a monostable circuit 46. Circuits 32 and 46 are both connected to be triggered by the output of circuit 45 and each produces a positive going pulse when the output of circuit 45 goes high, the pulse from monostable circuit 46 being longer than that from monostable circuit 32. The minimum duration of pulses from the circuit 45 is longer than that of the pulses from monostable circuit 46.

The values of resistors 40, 42 have values chosen so that in the period when the output of monostable circuit 46 has ceased, but the output of circuit 45 is still high, the voltage at the base of transistor 38 is such that it is just one diode forward voltage drop higher than the voltage across resistor 28 at a specific desired current value. The value of resistor 42 is such that transistor 33 is saturated whatever the current in resistor 28.

The pulse duration control circuit 45 has inputs from several engine operating parameter transducers A, B, C, and D, which sense such parameters as engine speed, engine intake manifold pressure, ambient and/or coolant temperature, rate of throttle pedal movement. If desired the circuit 45 may also provide an output to the ignition control circuit 10 to vary the timing and mark-to-space ratio of its output in accordance with one or more of these engine parameters. The circuit 45 is triggered by a signal from circuit 10 via a delay circuit 47.

In operation a cycle of operation may be considered as starting each time transistor 11 is switched on before a spark is required. The current in the resistor 12 is controlled by the circuit 10 and this current is shared between the primary winding of the ignition coil 16 and the inductor 20. These currents grow at rates depending on the respective inductance values of ignition coil 16 and inductor 20 towards the values determined by the values of the resistors 17, 21. When the time for a spark arrives the base drive to transistor 11 from the circuit 10 is discontinued. This interruption of the conduction of transistor 11 causes high voltage surges to develop in the primary winding of the ignition coil 16 and in the inductor 20. The surge in the ignition coil causes a spark in the usual way, the zener diode 9 conducting and turning the transistor 11 partially on to limit the surge voltage. Meanwhile the surge in inductor 20 causes current flow to be induced in the secondary winding 22, firing thyristor 24 and causing the electrical energy in the inductor 20 to be transferred to the capacitor 25, charging the latter to a high voltage. The diodes 15, 19 ensure independence of the two surges and their results, although the final voltage on the capacitor 25 is limited by the zener diode 9. Once capacitor 25 is charged to this limit voltage any excess energy in inductor 20 is dissipated by transistor 11. Typically the voltage on capacitor 25 rises approximately sinusoidally to about 350 V (in a 12 V system) and then remains at that level whilst the current in the transistor 11 falls linearly to zero, during which time the thyristor 24 becomes non-conducting.

The delay introduced by the delay circuit 47 is long enough to ensure that all the above operations are completed before the injection solenoid pulse is commenced. When the pulse from circuit 45 does commence the immediate effect is for a trigger pulse to be applied to the triac 26 by monostable circuit 32 and for the transistors 38 and 33 to be turned hard on by the monostable circuit 46. The trigger pulse fires the triac 26 so that the high voltage stored on the capacitor 25 is connected across the solenoid 27. This assures rapid flux growth in the solenoid 27 and hence a quick opening response.

The voltage on the capacitor 25 now falls as it discharges into the solenoid 27 until it falls below the voltage at the collector of transistor 33 (which was protected from the high voltage by the diode 34). Current flow in the solenoid 27 is then diverted via the transistor 33 and diode 34, and hence the triac 26 becomes non-conductive. After a predetermined delay (determined by monostable circuit 46) long enough to permit the solenoid valve opening movement to be completed the saturating base drive to transistor 38 from monostable circuit 46 is removed, transistor 38 thereafter acting to provide closed loop current control by modulating the base current in transistor 33. At this stage the current in the resistor 28 is in excess of the reference level so that no base drive to transistor 33 is provided, resulting in a reverse voltage surge being generated by winding 27. The zener diode 35 now acts to limit the voltage across transistor 33, the latter dissipating energy until the current falls to the reference level at which the current is maintained until the completion of the duration of the control pulse from circuit 45. At that stage the zener diode 35 acts again to control the rate of current decay.

If desired the circuit may be combined with the circuit described in co-pending applications nos. 80303166.5 (EPC) 187,882 (USA) and 129353/80 (Japan) for rapidly resetting the solenoid flux at the end of the pulse duration.

In the modification shown in FIG. 2 the inductor 20 is connected in series with the primary winding of the coil 16. An additional power zener diode 50 is required in this case to limit the voltage at the junction of the primary winding of coil 16 and the inductor 20. The zener diode 50 has a break-down voltage about half that of the zener diode 9 and determines the maximum voltage to which the capacitor 25 can be charged.

In a further modification (not shown) which can be applied to either FIG. 1 or FIG. 2, the inductor 20 is not connected directly to the thyristor 24, but is the primary of a transformer, the secondary of which has the thyristor 24 and capacitor 25 connected across it.

Turning finally to FIG. 3, the modification shown therein involves the combination of the ignition coil and the inductor into a single integrated transformer. As shown the primary winding 51 is connected in series with the resistor 17 between rail 18 and the collector of transistor 11. The ignition secondary 52 is conventionally connected, but an additional secondary 53 has one end grounded and the other end connected across a diode 124 (which is used instead of thyristor 24), and capacitor 25 in series. A diode 54 and zener diode 55 are connected in series across the winding 53 to limit the surge voltage thereon.

It is necessary for the windings 52 and 53 not to be well coupled when winding 51 becomes open circuit in order to enable a high voltage to be developed quickly across winding 52 despite a low initial voltage on winding 53 due to loading by capacitor 25.

The transformer core may be of conventional three limb transductor form using stampings or C-cores in symmetrical or unsymmetrical arrangement. In one preferred arrangement, stampings are used in an unsymmetrical 3-limb assembly in which the centre limb carries the common primary 51 and the two outer limbs have central air gaps and carry the respective secondary windings 52, 53.

I claim:

1. A combined ignition control and fuel injection valve solenoid operating circuit comprising:

an ignition control circuit, said circuit including a first semi-conductor switch element means for controllably interrupting current flow in an ignition coil;

an energy storage element;

an inductive means, responsive to said switch element means interrupting current flow in an ignition coil, for storing electrical energy in said energy storage element; and injection valve solenoid control means for energizing an injection valve solenoid, said control means including means for connecting said energy storage element to said injection valve solenoid when said control means energizes said injection valve solenoid.

2. A circuit as claimed in claim 1 in which said energy storage element is a capacitor.

3. A circuit as claimed in claim 2 in which said inductive means comprises an inductor having a main winding connected in circuit with said switch element means, a secondary winding coupled with said main winding, and a semi-conductor switch device means, responsive to said secondary winding, for connecting said main winding to said capacitor upon interruption of current flow in said ignition coil.

4. A circuit as claimed in claim 3 in which said switch device means is a thyristor having its anode cathode path connecting the main winding to the energy storage capacitor and the secondary winding connected across the gate-cathode thereof.

5. A circuit as claimed in claim 3 or 4 in which said inductor main winding is in parallel with the ignition coil.

6. A circuit as claimed in claim 3 or 4 in which the inductor main winding is in series with the ignition coil.

7. A circuit as claimed in claim 2 in which said solenoid control means connecting means comprises a second semi-conductor switch element means for connecting the energy storage capacitor to the injection valve solenoid, and means for triggering said second switch element means at the commencement of solenoid energisation.

8. A circuit as claimed in claim 7 in which said second switch element means comprises a controlled rectifier switch, said solenoid control means further including a semi-conductor element means for providing current to the solenoid after said capacitor has discharged such that the controlled rectifier switch ceases to conduct.

9. A circuit as claimed in claim 8 in which said semiconductor element means comprises: a transistor; and means for initially maintaining said transistor in saturation providing high level pull-in current, and for subsequently controlling the transistor conduction for maintaining a desired lower level hold-in current during solenoid energisation.

* * * * *